US005888008A

United States Patent [19]

Obersteller et al.

[11] Patent Number: 5,888,008

[45] Date of Patent: Mar. 30, 1999

[54] WRITING INSTRUMENT WITH REFILLABLE RESERVOIR

[75] Inventors: Udo Obersteller, Langenhagen; Bruno Künzler, Pattensen, both of Germany

[73] Assignee: Pelikan GmbH, Hanover, Germany

[21] Appl. No.: 854,924

[22] Filed: May 13, 1997

Related U.S. Application Data

[63] Continuation of Ser. No. 346,458, Nov. 29, 1994, abandoned.

[30] Foreign Application Priority Data

Nov. 30, 1993 [DE] Germany ..... 43 40 760.9
Nov. 30, 1993 [DE] Germany ..... 43 40 658.0

[51] Int. Cl.[6] ..... B43K 5/08; B43K 5/10

[52] U.S. Cl. ..... 401/230; 401/119; 401/151; 401/232

[58] Field of Search ..... 401/151, 230, 401/232, 119

[56] References Cited

U.S. PATENT DOCUMENTS

| | | | |
|---|---|---|---|
| 2,603,188 | 7/1952 | McKay . | |
| 2,646,777 | 7/1953 | Zarur . | |
| 2,737,329 | 3/1956 | Bolsey . | |
| 2,938,499 | 5/1960 | Lindenbaum . | |
| 3,023,737 | 3/1962 | Marban | 401/151 |
| 3,205,919 | 9/1965 | Kovacs . | |

FOREIGN PATENT DOCUMENTS

| | | | |
|---|---|---|---|
| 418 397 A1 | 3/1990 | European Pat. Off. . | |
| 0 621 140 A1 | 4/1994 | European Pat. Off. . | |
| 255 993 | 2/1949 | Germany . | |
| 33630 | 8/1956 | Germany | 401/230 |
| 12 10 716 | 2/1966 | Germany . | |
| 37 33 774 | 4/1988 | Germany . | |
| 86 21 282.6 | 1/1989 | Germany . | |
| 450447 | 7/1949 | Italy | 401/230 |
| 496169 | 7/1954 | Italy | 401/230 |
| 6 570 | 2/1916 | United Kingdom . | |

*Primary Examiner*—Steven A. Bratlie
*Attorney, Agent, or Firm*—Herbert Dubno

[57] ABSTRACT

A writing instrument has a supply chamber connected to reserve chamber by a refilling valve actuated by a plunger which is controlled by a push button formed with a self-closing membrane type valve through which the reserve chamber can be filled from a receptacle by a hollow needle. A separating valve at the end of the plunger closes before the refilling valve is opened to ensure that no ink under pressure will be forced into the ink flow regulator and point of the instrument during the refilling process.

13 Claims, 5 Drawing Sheets

WRITING INSTRUMENT WITH REFILLABLE RESERVOIR

CROSS REFERENCE TO RELATED APPLICATION

This is a file-wrapper continuation application Ser. No. 08/346,458 filed 29 Nov. 1994 now abandoned.

FIELD OF THE INVENTION

Our present invention relates to a writing instrument, especially a reservoir-type writing instrument which can be refillable with ink or another writing fluid and of the type in which a supply chamber communicates by a connecting passage with a flow regulator and a writing point or tip. More particularly, the invention relates to a writing instrument of this type in which there may also be a reserve chamber from which the supply chamber is refillable and which has a refilling valve between these two chambers which is normally closed but which, when open, can connect the refilling chamber to the supply chamber. In particular, the invention is applicable to fountain pens and other kinds of pens, to felt-tip, wicking or ball-type markers and, in general, to any writing instrument utilizing a liquid ink and having a refillable reservoir. The term "writing instrument" will be understood here to apply to the reservoir itself whether or not it is equipped with a writing tip, as long as it can be so equipped.

BACKGROUND OF THE INVENTION

German patent document DE-U-86 20 385 describes a writing instrument of the aforedescribed type having a reserve chamber which, in the usual orientation of the instrument for writing purposes, is located above the supply chamber. The valve element of the refilling valve is connected with a plunger which is actuatable at the end of the reserve chamber opposite the end of the instrument provided with the writing tip or nib. By depressing this end of the plunger, the valve element is displaced from its normally closed position into an open position and then subsequently can return to its closed position.

With the known writing instrument of this patent document, in the closed position of the refilling valve, the volume of the supply chamber is exclusively effective. The supply chamber can be so constructed that the greatest amount of air possible is permitted via the equalizing capacity of the capillary system, to dominate the flow of ink from the tip. This ensures that nonuniform ink flow is avoided and ragged writing is prevented.

When the supply chamber is emptied in the course of writing, it must be refilled with ink from the reservoir chamber.

The writing instrument of DE-U-86 20 385 has the drawback that after the supply chamber has been refilled from the reservoir chamber, refilling of the reserve chamber with ink is not possible and thus the instrument must be discarded when the ink in both the supply chamber and the reserve chamber has been fully consumed.

U.S. Pat. No. 2,646,777 discloses a refillable writing instrument in which the supply chamber at the end opposite that provided with the pen point, is provided with a piston pump which can allow a suction tube projecting from the supply chamber to be operated. To refill the supply chamber, the suction tube is immersed in ink in an ink vessel and by up-and-down movement of the instrument, the piston pump is actuated.

This system has the drawback that, during refilling, the pressure rise in the supply chamber causes ink in the flow regulator to feed through the pen point or tip and contaminate the fingers of the user and the exterior of the instrument. Overfilling of the supply chamber and the ink compartment in the flow regulator can readily occur with this system so that the writing produced by the instrument can be ragged. Finally, the instrument is difficult to manipulate and, because of the suction tube projecting from the supply chamber, required that an additional protective cap or sleeve be provided.

OBJECTS OF THE INVENTION

It is the principal object of the present invention to provide an improved writing instrument which allows refilling of the ink reservoir without drawbacks of earlier refillable instruments.

It is a more specific object of this invention to enable a writing instrument of the aforedescribed type to be repeatedly refilled with ink or another writing liquid without the danger of overfilling and associated leakage of the ink and without ragged delivery of ink through the instrument writing tip.

Still another object of the invention is to provide a writing instrument which is particularly simple to refill and easy to use.

Yet another object is to provide a writing instrument which throughout the handling thereof, remains clean and has a reduced tendency to soil the fingers of a user.

SUMMARY OF THE INVENTION

These objects and others are attained, in accordance with the invention, wherein the reserve chamber is accessible from the exterior through a self-closing valve via a refilling opening in the body of the reservoir or writing instrument and wherein the instrument is provided with an actuator which can be held in a position permitting refilling but blocking the escape of ink from the supply chamber.

According to the invention, therefore, a refilling vessel has means for holding open its valve when it is applied to the writing instrument while the connecting passage which is normally open, is blocked by the actuating member upon refilling of the reservoir with ink.

According to an important aspect of the invention, a separating valve between the flow regulator and the supply vessel is closed before a valve-connecting reserve chamber with the supply chamber is opened and, conversely, this refilling valve is closed before the separating valve is opened.

More particularly, a writing instrument of the present invention can comprise:

- a shaft formed at one end with a writing tip, and an ink flow regulator connected to the tip;
- means forming a supply chamber in the shaft communicating with the flow regulator, and a reserve chamber in the shaft communicating with the supply chamber for replenishing ink in the supply chamber from the reserve chamber;
- a normally open separating valve between the supply chamber and the flow regulator for blocking passage of ink from the supply chamber to the flow regulator and the tip during replenishing of ink in the supply chamber;
- a normally closed refilling valve between the reserve chamber and the supply chamber openable to enable replenishing of ink from the reserve chamber in the supply chamber;

a common actuating element in the shaft for both the valves and constructed and arranged upon displacement of the actuating element in one direction to close the separating valve prior to opening of the refilling valve and, upon displacement of the actuating element in an opposite direction, to close the refilling valve prior to opening of the separating valve; and a self-closing valve communicating with the reserve chamber and opening for filling of the reserve chamber from a supply vessel and automatically closing upon termination of filling of the reserve chamber.

It will be apparent that the writing instrument of the invention allows the reserve chamber to be refilled through the sleeve-closing valve while the refilling valve can block flow from the reserve chamber into the supply chamber or, if this valve is open, the separating valve blocks flow from the supply chamber to the passage communicating with the flow regulator and the tip. The ink can be supplied to the device upon refilling only in an amount necessary to refill the refilling chamber or, should the refilling valve be open in the two chambers, an excess of ink cannot be supplied.

Furthermore, overfilling of the type that ink will leak from the writing tip is precluded. The same applies for replenishment of the ink from the refilling chamber to the supply chamber. Before opening of the refilling valve, the actuator closes the separating valve so that when, indeed, the refilling valve is opened, the separating valve has already blocked the flow to the tip.

An elevated temperature in the reserve chamber in excess of an atmospheric pressure which can arise by refilling with ink or changes in atmospheric pressure or temperature cannot give rise to a leakage of ink from the tip and from the capillary system of the flow regulator, since the pressure in the supply chamber is relieved as the actuator returns to its ground or normal position, especially if the actuator is provided with a piston which, upon return, increases the effective volume of the supply chamber.

Since the supply chamber is refilled with ink from the reserve chamber, the pressure equalizing capacity can be optimally matched to the ability of the flow regulator to maintain a continuous ink flow without disruption. The reserve chamber can be made as large as possible, independently of the supply chamber, within limits determined only by the desired external dimensions of the instrument.

In order to ensure that, upon opening of the separating valve and actuation of the refilling valve, the pressure in the supply chamber will drop, means can be provided on the actuating plunger to increase the volume in the supply chamber upon return of the actuating plunger to its ground position. In practice such means can be a valve member refilling valve which has the configuration of a piston. This reduction in pressure opposes any drive that the ink may have toward the point of the instrument upon opening of the separating valve. The piston can move axially in the refilling valve.

According to another feature of the invention, the two valves can be actuated by a common plunger by fastening both valve members thereto, in which case the displacement for closure of the separating valve is smaller than the displacement for opening of the refilling valve. The closure elements of the or both valves can be axially movable with and relative to the plunger so that differences between the closure displacement and the respective valve element and the actuating displacement of the plunger can be compensated.

According to a feature of the invention, the valve element of the separating valve is an elastically deformable tube or hose which is affixed to the closure element of the refilling valve and having a free end pressed against a valve seat at the end of the assembly proximal to the tip. This configuration of the separating valve has been found to minimize fabrication and mounting costs and provides a valve of minimum wear. According to another feature of this invention, the refilling valve and/or the separating valve has a valve seat formed with a cylindrical bore and within which the valve element is axially movable at least to a limited extent.

The ink flow through the open refilling valve and/or the open separating valve can be improved by providing, in the vicinity of the respective valve seats, ribs which extend in the flow direction and counteract surface tension and an adhesion of individual droplets in the region of the throughgoing opening of the valve.

For actuation of the refilling valve and the separating valve, preferably a push button is provided which can close the end of the reservoir for the writing instrument opposite the end provided with the pen point or tip. The push button can be braced against a compression spring which holds it in its ground position in which the refilling valve is closed or the separating valve is opened. It has been found to be advantageous if the push button is not actuated with sudden movements or sporadically.

This can be achieved, according to the invention by providing the push button with an external thread and screwing into a threaded bore of a sleeve-shaped threaded knob.

It has been found to be advantageous to make the reserve chamber cross section bounded by the push button greater than the cross section of the closure element or valve member of the refilling valve in the flow cross section between the supply chamber and the refilling chamber. In this manner, upon actuation of the push button, the volume of the reserve chamber is somewhat diminished. This result is a slight pressure increase which is applied to the ink in the supply chamber. By release of the push button, the opposite relationship holds and the starting pressure is restored in the supply chamber and the reserve chamber.

According to a further feature of the invention, the refilling opening comprises a centrally-disposed bore in the push button, communicating with the reserve chamber and preferably blocked by the self-closing valve which can be a slot or membrane of an elastomeric material and which tends to self-seal and seal when the respective hollow tube or needle is retracted therefrom. The refilling vessel thus has such a hollow needle with which the self-closing valve can be pierced.

With relatively simple means, therefore, the reservoir can be sealed again once the reserve chamber has been filled without requiring removal of a cover or a comparable closure member.

Refilling of the reserve chamber is thus simplified and can be effected in a clean way.

Through the hollow needle, ink can be alternately forced into the reserve chamber and air drawn or sucked out of the reserve chamber.

The push button can be provided with a concentric guide surface, e.g. a recess for receiving a guide element of the vessel, e.g. a collar centering the needle in the bore. To protect the closure elements and to avoid their contact, the closure element can be recessed in a bore whose diameter is only slightly greater than that of the hollow needle.

The invention also comprises, therefore, a writing instrument which comprises:

a shaft formed at one end with a writing tip, and an ink flow regulator connected to the tip;

means forming a supply chamber in the shaft communicating with the flow regulator;

a normally open separating valve between the supply chamber and the flow regulator for blocking passage of ink from the supply chamber to the flow regulator and the tip during replenishing of ink in the supply chamber;

an actuating element in the shaft for the valve and constructed and arranged to close the separating valve prior to filling of the supply chamber; and a self-closing valve communicating with the chamber and opening for filling of the chamber from a supply vessel and automatically closing upon termination of filling of the chamber.

The filling vessel for filling this writing instrument can comprise:

an ink containing receptacle;

a filling tube in the form of a needle adapted to pierce a self-closing valve of the writing instrument and communicating with ink in the receptacle;

an automatic valve in the receptacle having an actuating member operable upon piercing of the self-closing valve by the needle to establish communication between the tube and the ink in the receptacle; and means for alternatingly raising and lowering pressure in the receptacle.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
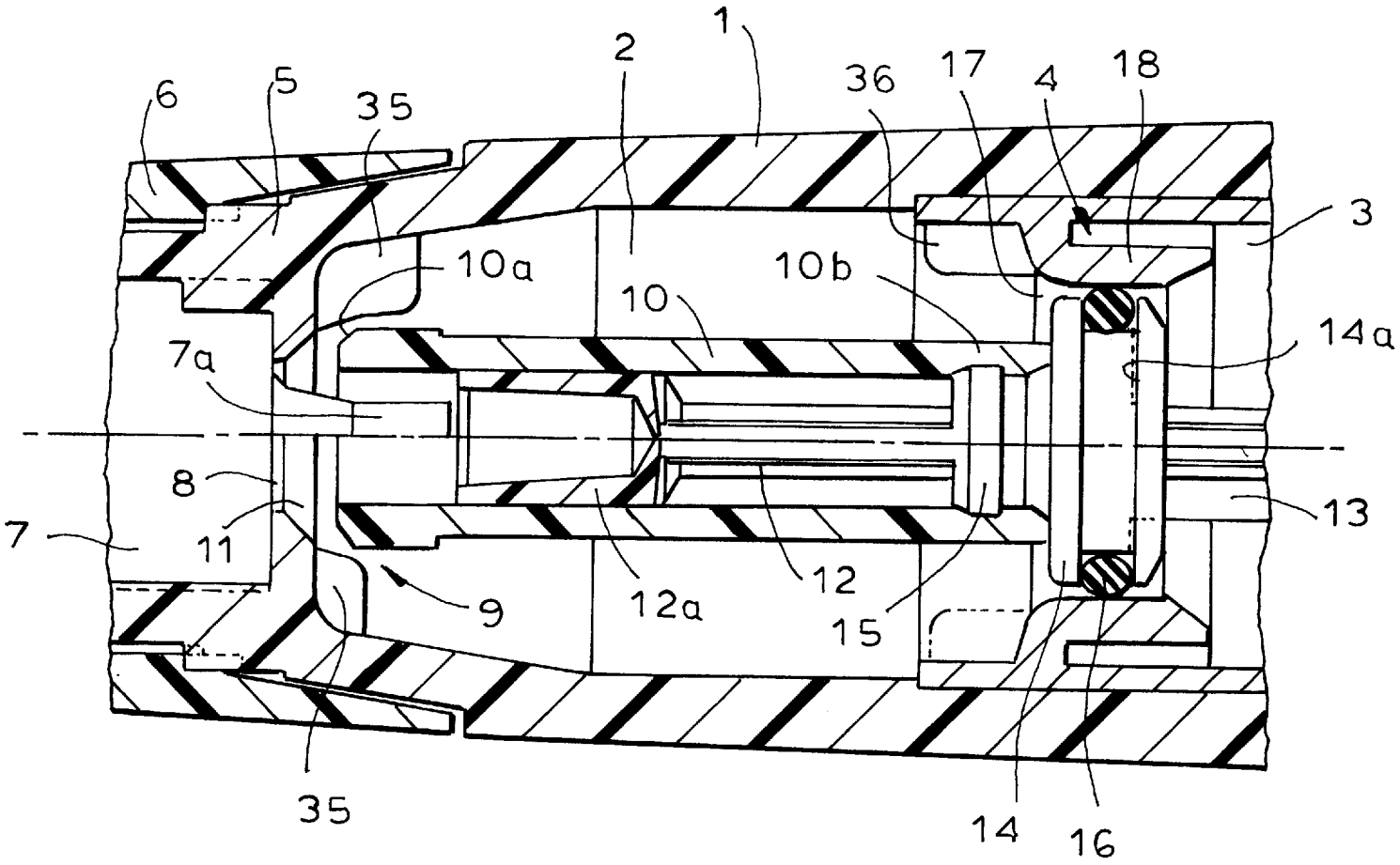
FIG. 1 is a longitudinal section through the reservoir of a writing instrument according to the invention.
Figure 2:
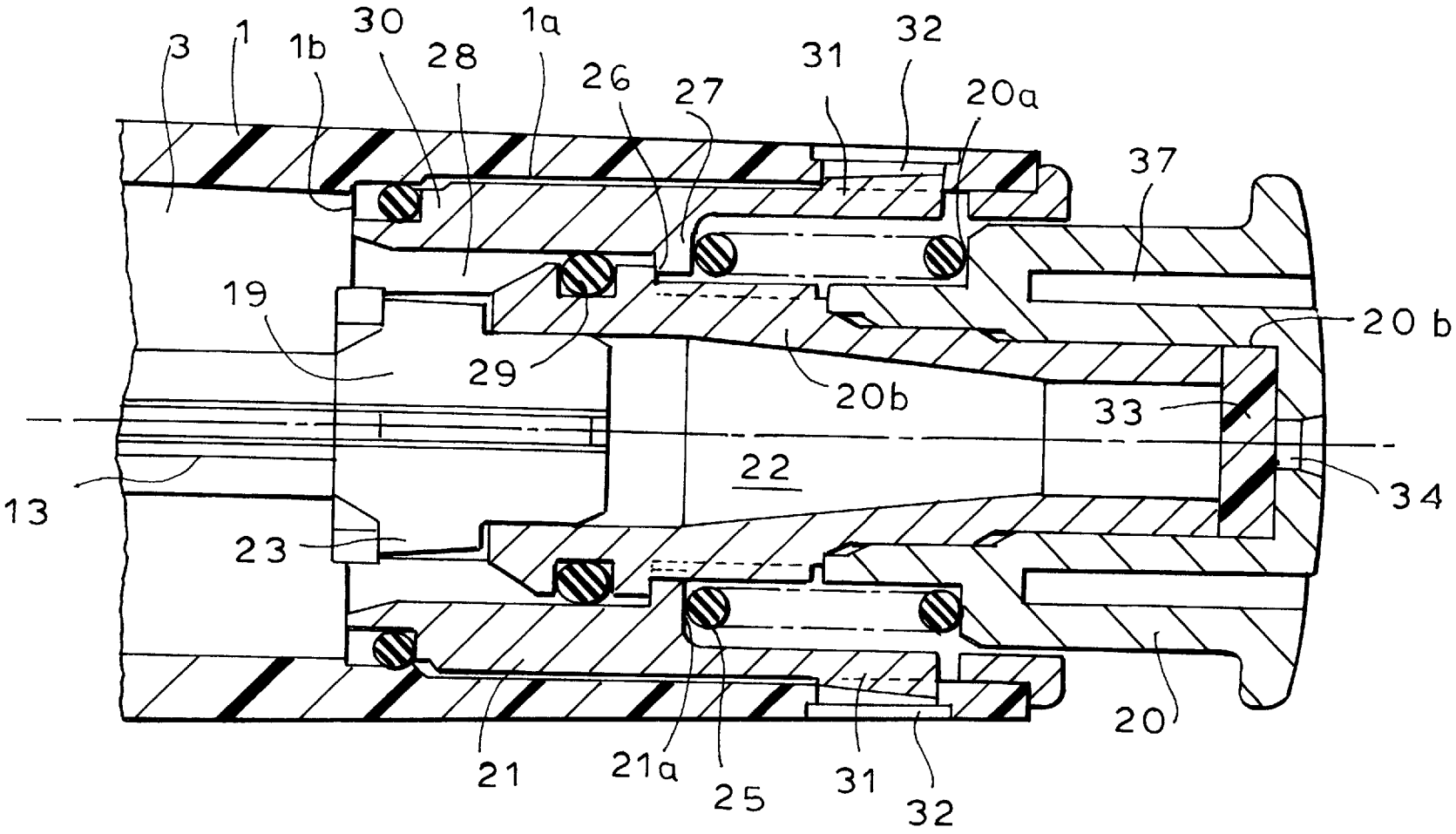
FIG. 2 is a longitudinal section of the end opposite that provided with the writing tip.

The reservoir of the writing instrument shown in FIGS. 1 and 2 comprises a tubular shaft 1, at the left-hand end of which a supply chamber 2 is formed (FIG. 1) and adjacent this supply chamber is a reserve chamber 3 (FIG. 2) communicating with the supply chamber 2 by a refilling valve 4 separating the two chambers from one another.

Not shown in detail because it is conventional in the art, is a writing tip 6 which can be of any type, e.g. a fountain pen tip with its usual nib, communicating with an ink flow regulator 7 having a capillary passage and equalization chambers represented collectively at 7 and having a boss 7*a* extending past a bore 8 by means of which the supply chamber 2 communicates with the tip 6.

A separating valve 9 is provided for closing off the tip from the supply chamber 2. The separating valve 9 can comprise a tubular closure element 10 of elastic material functioning as a hose which can be axially compressed and, upon axial compression, can bulge outwardly. Within the tubular closure element 10, a cap 12*a* can be provided to fit over the boss 7*a*.

At its end 10*a* turned toward the tip, the closure element 10 is bevelled to engage a conical seat 11 of the separating valve, surrounding the bore 8.

The tubular element 10 also surrounds an end 12 of a plunger 13 carrying the valve member 14 of the refilling valve 4.

To retain the closure element 10 on the end 12 of the plunger 13, the latter is formed with a bead 15 elastically engaging in the opposite end lob of the closure element 10. In the axial direction, moreover, the closure element 10 is additionally braced against the valve member 14.

Guide ribs 35 are formed within the supply chamber 2 adjacent the conical seat 11 to guide the ink toward the open valve when flow is permitted in the normal position of the plunger and the valve member 14.

The valve member 14 has the configuration of a cylindrical piston which is formed with a circumferential curve 14*a* receiving a sealing ring 16 which can ride against a cylindrical wall of the seat 17 of the refilling valve. The seat 17, in turn, is formed on a sleeve-like partition 18 separating the supply chamber 2 from the reserve chamber 3.

The end of the plunger 13 opposite that which carries the tubular closure element 10 (FIG. 2) has a push button or knob 20 fastened thereto. The push button 20 is axially slidable in a sleeve-like support 21 closing the end of the shaft 1. The push button or knob 20 also has a longitudinal bore 22 in which the end 19 of cruciform cross section can engage. In the axial direction the end 19 is braced against the push button by radial projections 23 engaging in undercut slits in the wall of the push button or knob 20.

A compression spring 25 is received in a recess 24 in the periphery of the push button or knob 20. The compression spring 25 is braced at one end against a shoulder 20*a* of the push button and at the other end against a shoulder 21*a* of the sleeve 21 and thus holds the push button or knob 20 normally in the position shown in FIG. 2 in which it projects from the sleeve 21 and in which a shoulder 26 bounding the recess 24 can abut against a shoulder 27 extending inwardly on the sleeve 21. The sleeve 21 has a cylindrical bore 28 which is sealed relative to the reserve chamber 3 by a sealing ring 30. The sleeve 21 can terminate at a shoulder 1*b* on the inner wall of the shaft 1 and this shaft can be enlarged at 1*a* to receive the sleeve 21. The push button or knob 20 can have a sliding sealing ring 29 by means of which the push button is sealed with respect to the cylindrical bore 28.

The sleeve 21, as has been noted, is fitted into the open end 1*a* of the shaft 1 and is sealed with the ring 30 relative to the latter to fasten the sleeve 21 in the shaft 1, the sleeve 21 has spring tongues 31 which have formations engaging at their ends in cutouts 32 in the wall of the shaft 1.

For refilling of the reserve chamber 3, the longitudinal bore 22 of the push button or knob 20 is formed with a wall 33 of elastomeric material forming a self-closing valve. This wall is accessible through a narrow bore 34 and can be pierced by a needle of the filling vessel which then can form a component 55 in the wall 33 (see FIG. 4) which is held open by the needle until the reserve chamber 3 is filled. The component 55 seals itself or closes by the self-contraction of the material of the wall 33.

The air driven out as the fresh ink is added is withdrawn by the intermittent pumping in and out action of the filling vessel.

To ensure that the needle of the filling vessel will align precisely with the bore 34, the push button or knob 20 is provided with a concentric annular groove 37 in which a collar of the filling vessel surrounding the needle is insertable.

When it is required to feed ink into the supply chamber 2, the push button or knob 20 is actuated to open the valve 4 and allow ink to flow from the reserve chamber 3 into the supply chamber 2. In this operation, initially the separating valve 9 is closed and thus communication from the supply chamber 2 to the ink flow regulator 7 is interrupted by engagement of the closure element 10 with the seat 11. After closing of the separating valve 9, further depression of the push button or knob 20 elastically compresses the element 10 in the longitudinal direction and opens the valve 4. The valve member 14 is thus brought out of its engagement with the seat 17 with its sealing ring 16 to allow the ink to pass from the reserve chamber 3 into the supply chamber 2. By the ribs 36 which are provided within the supply chamber adjacent the seating surface 17, flow of ink is facilitated. Since during this ink transfer the supply chamber 2 is closed off by the separating valve 9 from the ink regulator, any superatmospheric pressure within the reserve chamber 3 cannot cause ink to leak from the point.

When the supply chamber 2 has been refilled with ink, as can be evidenced through a viewing window (not shown) the push button or knob 20 is released and is returned to the starting position shown in FIG. 2 by the compression spring. First the refilling valve 4 is closed and then the separating valve 9 is opened. Even before the opening of the separating valve 9 and during the opening movement of the plunger 13, the displacement of element 14 enlarges the volume of the supply chamber 2 to relieve pressure in the supply chamber 2 and prevent an excess pressure in the supply chamber from driving ink out through the flow regulator.

Where the writing instrument does not have a separate reserve chamber 3, it suffices to omit the partition 18 so that upon refilling of the reservoir through a needle piercing the wall 33, the push button is depressed to close the separating valve 9, thereby preventing leakage of ink during the refilling of the supply chamber 2 from the needle. For this purpose the groove 37 should have a depth only sufficient to ensure that the push button can be depressed before the needle pierces the wall 33.

Figure 3:
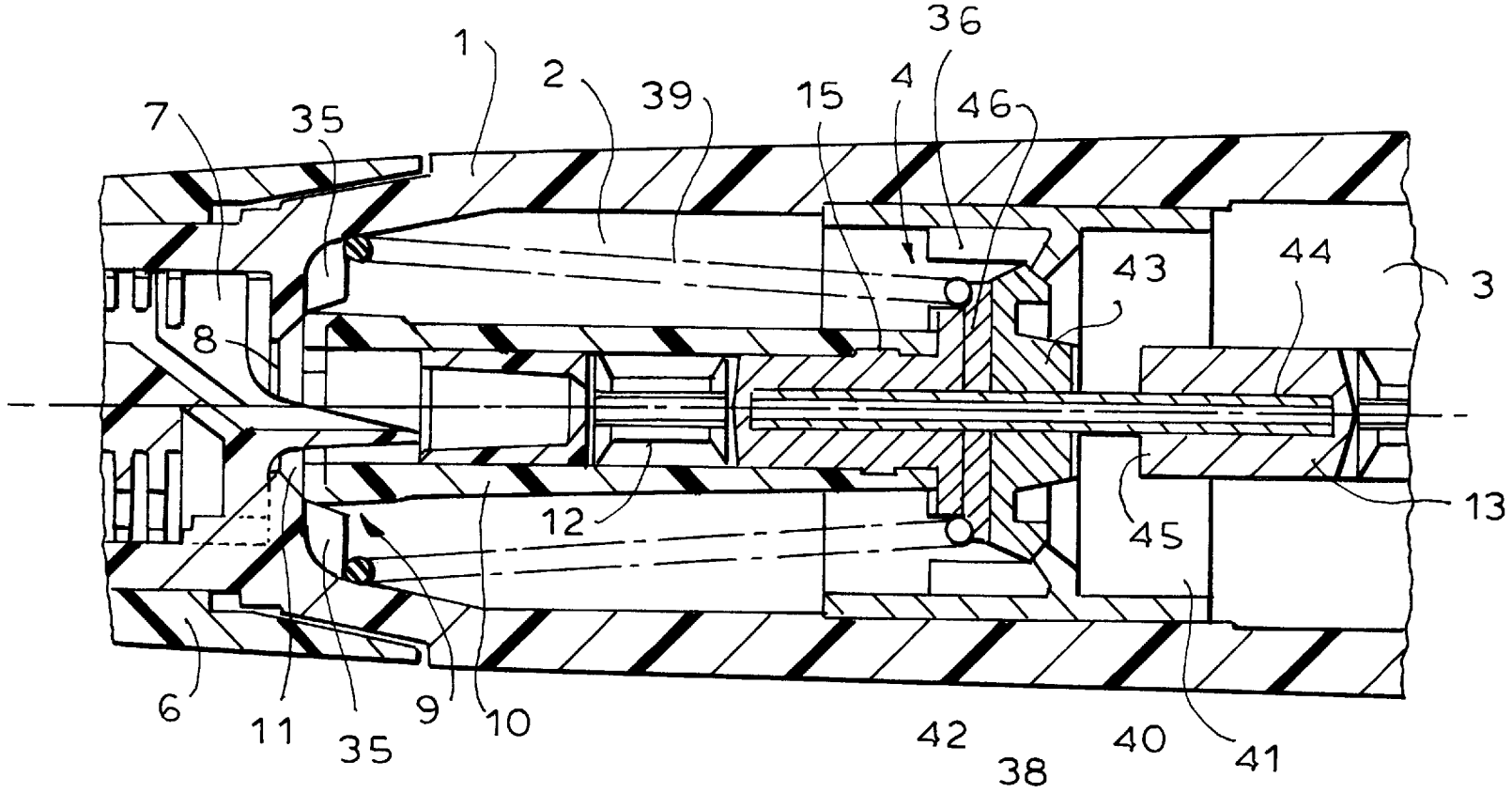
FIG. 3 is a longitudinal section through the supply chamber and the adjacent portion of another embodiment of the writing instrument.
Figure 4:
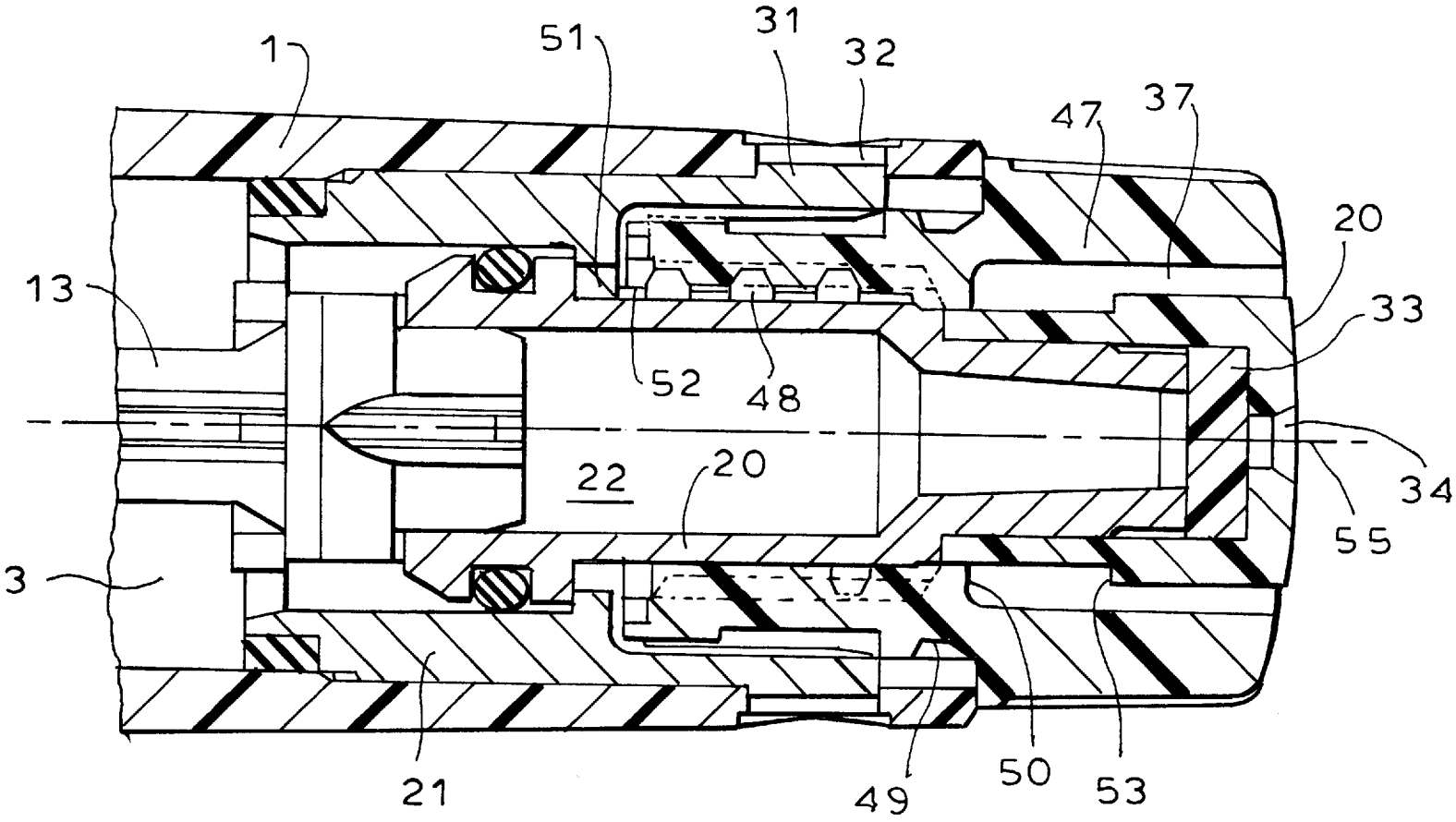
FIG. 4 is a longitudinal section through the end of this latter writing instrument turned away from the tip.

FIGS. 3 and 4 show an embodiment of the invention which is generally similar to FIGS. 1 and 2 in function but wherein the refilling valve 4 has a closure element 38 which is braced against a compression spring 39 which presses the closure element 38 against a valve seat 40. The valve seat 40 is formed by an annular collar in the bore of a sleeve 41 fastened in a liquid-tight manner in the shaft 1 and separating the supply chamber 2 from the reserve chamber 3.

The closure element 38, in turn, is comprised of a valve plate 42 against which the compression spring 39 is braced and a value element 43 which has a sealing surface at its outer edge engaging the valve seat 40 in the closed position illustrated in FIG. 3. Through a central bore in the valve plate 42 and the valve element 43, a cylindrical pin 44 extends which rigidly connects the plunger 13 with the plunger end 12. In the bore of the valve element 43 a pin 44 is sealed. The pin 44 has a smaller diameter than the plunger 13 and the end 12. The plunger 13 and the end 12 form mutually juxtaposed radial abutment surfaces between which the closure element 38 is shiftable in the axial direction. The spacing between the abutment surfaces 45, 46 is somewhat greater than the sum of the axial lengths of the closure element 38 and the closing stroke of the separating valve 9.

In FIG. 3, the refilling valve 4 is closed and the separating valve 9 is shown to be open. The abutment surface 46 lies against the valve plate 42 and the plunger 13 is held in this position by the compression spring 25 which is braced against the push button or knob 20 connected with the plunger 13. In this position of the valves 4, 9, the reserve chamber 3 is separated from the supply chamber 2 and the supply chamber 2 communicates via the open separating valve 9 with the ink flow regulator 7 of the tip.

When ink is to be fed from the reserve chamber 3 to the supply chamber 2, the push button or knob 20 is actuated and the plunger 13 together with the pin 44, the end 12 and the closure element 10 are moved to the left. The closure element 38 does not change in position because it is held by the compression spring 39. The pin 44 slides through the closure element 38 with lost motion and the abutment surface 46 recedes from the valve plate 42 while the abutment surface 45 approaches the valve element 43.

Still before the abutment surface 45 reaches the valve element 43, the end of the closure element 10 seats against the conical seat 11 to close the separating valve.

If the plunger is displaced further, the closing element 10 is axially compressed and the abutment surface 45 engages the value element 43 and moves it against the force of the compression spring 39 to open the refilling valve 4. The ink can pass from the reserve chamber into the supply chamber supported in the part by the capillary action of the ribs 36. The closed separating valve 9 prevents ink at the elevated pressure in the reserve chamber from being forced out through regulator 7 and the tip. Upon release of the push button or knob 20, the springs 25 and 39 close the refilling valve 4 first and then open the separating valve 9 to allow the device to return to its original position.

The embodiment illustrated in FIG. 4 substitutes for a finger-generated axial displacement of the push button or knob 20, the rotary movement of a rotary button 47 which is rotatably affixed to the open end of the shaft 1. The rotary button 47 has the configuration of a sleeve which surrounds the push button or knob 20 and is connected to the push button or knob 20 by a screw thread 48. In the axial direction, the rotary button 47 is held in place by the sleeve 21. More particularly, the sleeve 21 has a rotary inwardly-projecting shoulder 49 at its rear end which engages in an annular groove in the periphery of the rotary button 47. The sleeve 21 is slitted in the region of the shoulder 49 which facilitates the interfitting of the rotary botton 47 and the sleeve 21. In the mounted position of the sleeve 21 in the shaft 1, the shoulder 49 is secured by the shaft 1 against rotary spreading so that the rotary button 47 cannot be released.

Between the outer ends of the push button or knob 20 and the rotary button 47, by analogy to the embodiment of FIG. 2, an annular groove 37 to receive the guide collar of a filling vessel for refilling the reserve chamber 3 is provided. The bottom 50 of the annular groove 37 of rotary button serves as an abutment limiting the inward movement of the push button or knob 20 and limiting the depth of penetration of the needle and the guide collar into the writing instrument.

A projection 51 engages in a longitudinal groove 52 intersecting the screw thread and secures the push button or knob 20 against rotation relative to the sleeve 21.

If the rotary button 47 is rotated in the clockwise sense, looking from right to left in FIG. 4, the push button or knob 20 is moved to the left and via the plunger 13, actuates the refilling valve 4 and the separating valve 9 in the manner previously described.

In its end position, the botton or knob 20 rests with its abutment surface 53 against the bottom 50. In this position, in which the refilling valve 4 is open, the valve formed by the wall 33 has been displaced inwardly so that it can no longer be reached by the hollow needle of the filling vessel when the collar of this filling vessel is fitted into the annular groove 37 and the end of the collar engages against the bottom 50. Thus we can ensure that the ink cannot be forced into the reserve chamber 3 when the refilling valve 4 between the chamber is opened. This precludes the generation of a high pressure of ink in the reservoir when that high pressure can be communicated to the supply chamber 2. For return of the push button or knob 20 into the starting position shown in FIG. 4, in which the refilling valve 4 is closed and a filling of the reserve chamber 3 with ink is possible, the rotary button 47 is rotated in the opposite sense.

The actuation of the push button or knob 20 with the aid of the rotary button 47 has the advantage that the refilling valve 4 and the separating valve 9 are not actuated suddenly upon some impact against the end of the writing instrument. This precludes the undesired forcing of ink by inertia to the open point.

Figure 5:
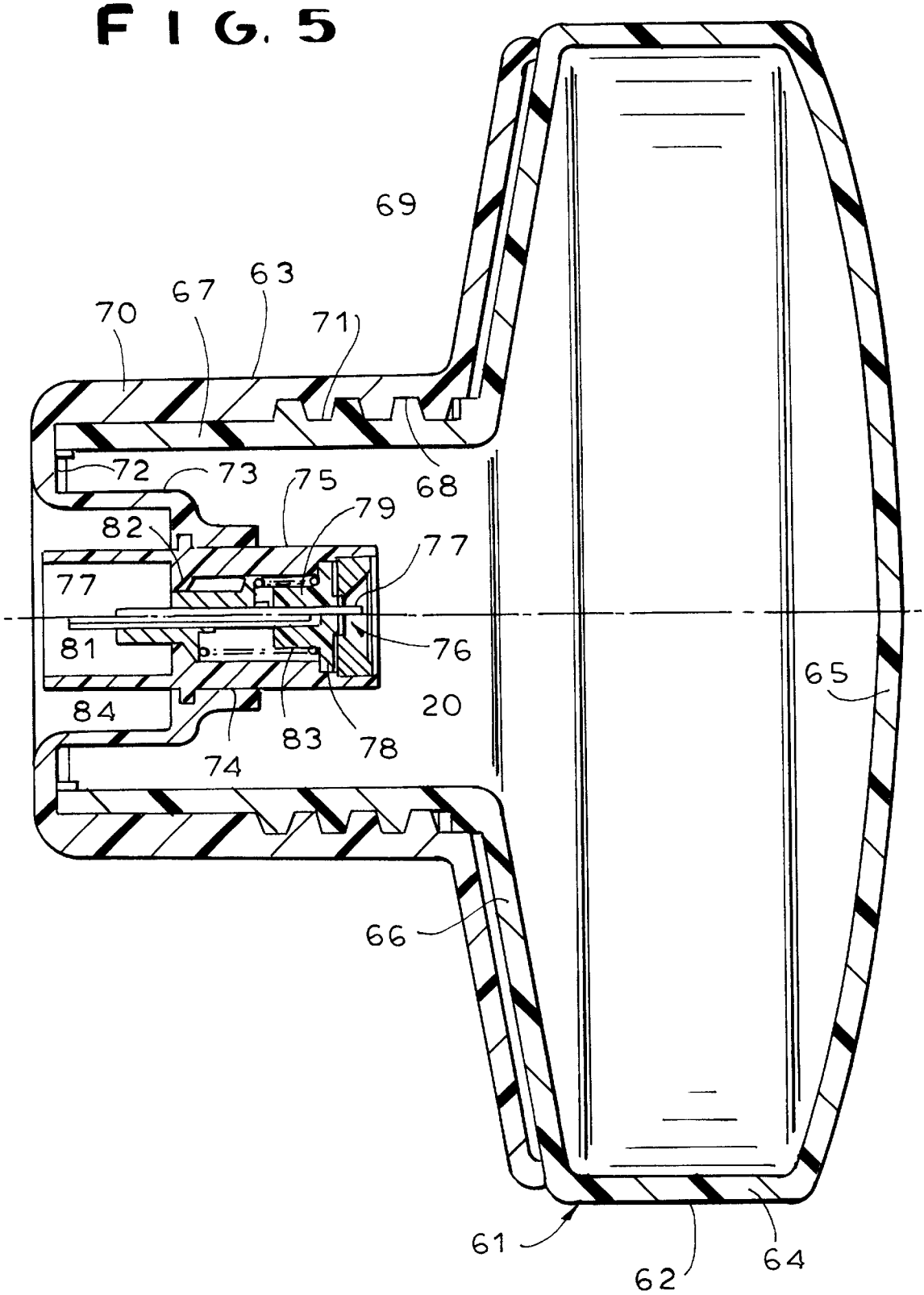
FIG. 5 is a cross section through a filling vessel for filling the reservoirs of the instrument of FIGS. 1–4.

In FIG. 5 we have shown a filling vessel which can be used for filling the instrument of FIGS. 1–4. This filling vessel is comprised of a receptacle 61 composed of an elastically-deformable hollow body 62 and a stiff shell 63. The hollow body 62 is formed with a cylindrical wall 64, a slightly outwardly bulging bottom 65 and a frustoconical wall 66. The frustoconical wall 66 has a cylindrical neck 67 which is formed on its exterior with a screw thread 68. The shell 63 has a frustoconical wall 69 and a cap 70 with an internal screw thread 71 which can be threaded on the neck 67 and sealingly closes the latter. The wall 69 corresponds in inclination to the wall 66 and has an outer edge bearing tightly upon the edge of the wall 66.

The bottom 72 of the cap 70 is formed with a boss 63 of cylindrical configuration extending into the neck 67. In a boss 74 of the boss 73, an insert sleeve 75 is fitted, containing a valve 76 and a filling tube 77 formed as a hollow needle.

The valve 76 is comprised of a cylindrical disk 78 on which a sleeve formation 79 is provided. Along its cylinder axis, the cylinder disk 78 is pierced by a needle which forms a self-sealing valve bore. The cylinder disk 78 is held by a ring 80 in the insert 75. The filling tube 77 is disposed on the side of cylinder disk 78 opposite the side turned toward the interior of the receptacle 61 and has an end extending into the bore of the formation 79. At its center, the filling tube 77 is connected with a spring plate 81 which rests against an annular shoulder 82 of the insert 75 and is guided with a slender portion in the latter. Between the spring plate 81 and the cylinder disk 78, a compression spring 83 is provided. The outer end of the insert 75 forms a guide sleeve or collar 84 which is concentric with but surrounds the outer end of the filling tube 77 with clearance.

The lower half of FIG. 5 shows the filling tube or filling tube 77 in its normal position in which the valve 76 is closed. In this position, the filling tube 77 is held by the prestressed compression spring 83 and the spring plate 81 against the annular shoulder 82.

When the reserve chamber 3 of an instrument according to FIGS. 2 or 4 is to be refilled with ink from the receptacle 61, the receptacle 61 is fitted with its guide sleeve or collar 84 onto the push button or knob 20 at the end of the reservoir and the filling tube 77 is moved to pierce the wall 33, the sleeve or collar 84 engaging in the annular groove 37 and the outer end of the needle projecting from the spring plate 81 passing the bore 34 and piercing the component 55 in the wall 33. The prestressed compression spring supports the friction force resisting the displacement without being compressed.

As soon as the spring plate 81 engages the push button or knob 20 around the needle, the force of spring 83 is exceeded and the filling tube 77 also penetrates the cylinder disk 78 to connect the receptacle with the instrument as shown at the upper part of FIG. 5. By intermittent compression of the elastically deformable bottom 65, ink is pumped from the receptacle 61 into the reserve chamber 3 and air is drawn out into the receptacle. When the filling process is terminated, the receptacle 61 is pulled away from the reservoir. The compression spring 83 forces the filling tube 77 out of the wall 88 when the spring plate 81 lies against the should 82, thereby allowing the wall 88 to self-seal and close the valve 76.

We claim:

1. A writing instrument, comprising:

a shaft formed at one end with a writing tip, and an ink flow regulator connected to said tip;

means forming a supply chamber in said shaft communicating with said flow regulator, and a reserve chamber in said shaft communicating with said supply chamber for replenishing ink in said supply chamber from said reserve chamber;

a normally open separating valve between said supply chamber and said flow regulator for blocking passage of ink from said supply chamber to said flow regulator and said tip during replenishing of ink in said supply chamber;

a normally closed refilling valve between said reserve chamber and said supply chamber openable to enable replenishing of ink in said supply chamber from said reserve chamber;

a common actuating plunger in said shaft for both said valves and constructed and arranged upon displacement of said actuating plunger in one direction to close said separating valve prior to opening of said refilling valve and upon displacement of said actuating plunger in an opposite direction, to close said refilling valve prior to opening of said separating valve; and a self-closing valve communicating with said reserve chamber and opening for driving out the air from and filling of said reserve chamber from a supply vessel and automatically closing upon termination of filling of said reserve chamber at superatmospheric pressure in said reserve chamber, said refilling valve being closed upon filling of said reserve chamber; and means mounted on said plunger and movable therewith for changing a volume of and thus a pressure in said supply chamber by:

(a) decreasing said volume upon closing of the separating valve and thereafter opening of the refilling valve to increase the pressure in the supply chamber receiving ink from the reserve chamber, and (b) gradually increasing said volume of the supply chamber to decrease the pressure generated therein upon receiving ink while closing said refilling valve but before opening of said separating valve after termination of filling of said supply chamber, so that ink is not driven out through said flow regulator upon opening of said separating valve.

2. The writing instrument defined in claim 1 wherein said common actuating plunger is a plunger axially displaceable in said shaft and said refilling valve is formed with a piston constituting a valve member thereof.

3. The writing instrument defined in claim 2 wherein said refilling valve and said separating valve are constructed and arranged that a displacement of said plunger to close said separating valve is smaller than a displacement of said plunger to open said refilling valve.

4. The writing instrument defined in claim 1 wherein said common actuating plunger is a plunger and at least one of said separating valve and said refilling valve has a valve member entrained by but axially movable relative to said plunger.

5. The writing instrument defined in claim 4 wherein said separating valve has a valve member formed as an elastically deformable tube and operatively connected with a valve member of said refilling valve, a free end of said elastically deformable tube being pressed against a valve seat surrounding a bore communicating between said flow regulator and said supply chamber upon closing of said separating valve.

6. The writing instrument defined in claim 4 wherein one of said separating valve and said refilling valve has a valve seat formed with a cylindrical bore, and a valve member received in said bore and limitedly axially movable therein.

7. The writing instrument defined in claim 4 wherein at least one of said separating valve and said refilling valves has a valve seat and flow-directing ribs adjacent said valve seat.

8. The writing instrument defined in claim 1 wherein said common actuating plunger is a plunger, said writing instrument further comprising a push button operatively connected to said plunger and closing an end of said shaft and said reserve chamber opposite said one end.

9. The writing instrument defined in claim 8, further comprising a compression spring bearing against said push button and urging said plunger into a normal position wherein said refilling valve is closed and said separating valve is open.

10. The writing instrument defined in claim 8 wherein said push button has an external screwthread and is threaded into a sleeve-shaped rotary knob for axial displacement by rotation of said rotary knob.

11. The writing instrument defined in claim 8 wherein said push button bounds a portion of said reserve chamber of a cross section greater than a cross section between said chambers receiving a valve member of said refilling valve.

12. The writing instrument defined in claim 8 wherein said push button is formed with a central passage aligned and communicating with said self-closing valve.

13. A writing instrument, comprising:

an elongated shaft extending along a longitudinal axis and formed at one end with a writing tip, and an ink flow regulator connected to said tip;

means forming a supply chamber in said shaft communicating with said flow regulator, and a reserve chamber in said shaft communicating with said supply chamber for replenishing ink in said supply chamber from said reserve chamber;

a normally open separating valve between said supply chamber and said flow regulator for blocking passage of ink from said supply chamber to said flow regulator and said tip during replenishing of ink in said supply chamber;

a normally closed refilling valve between said reserve chamber and said supply chamber openable to enable replenishing of ink in said supply chamber from said reserve chamber;

a common actuating plunger in said shaft and coaxial therewith for said refilling and separating valves and constructed and arranged to close said separating valve prior to filling of said supply chamber;

a push button operatively connected to said actuating plunger and closing an end of said shaft and said reserve chamber opposite said one end and being formed with a central passage, said push button having an external screwthread and being spaced radially inwardly from said shaft to form a groove therebetween;

a sleeve-shaped rotary button mounted axially fixed on said end of the shaft in said groove and threadedly on said push button and coaxial therewith, said rotary button being formed with a rearwardly open end portion spaced radially outwardly from said push button to form a guide channel therebetween for receiving a supply vessel and with an annular flange extending axially toward one end of the shaft on said groove; and a self-closing valve received in said central passage of said push button and communicating with said reserve chamber and being opened for filling of said reserve chamber from said supply vessel after the push button is in an outer position thereof, said self-closing valve automatically closing upon termination of filling of said chamber, said push button being movable axially upon rotation of said axially fixed rotary button between an inner position in which said separating valve is closed and said outer position of the push button in which the refilling valve is closed and the separating valve is open for refilling said reserve chamber from the supply vessel.

* * * * *